US012172046B1

(12) United States Patent
Li

(10) Patent No.: US 12,172,046 B1
(45) Date of Patent: Dec. 24, 2024

(54) ARM EXERCISE MACHINE

(71) Applicant: YongKang Haoduo Fitness Equipment Co., Ltd, Zhejiang (CN)

(72) Inventor: Li Li, Hubei (CN)

(73) Assignee: YongKang Haoduo Fitness Equipment Co., Ltd, Jinhua (CN)

( * ) Notice: Subject to any disclaimer, the term of this patent is extended or adjusted under 35 U.S.C. 154(b) by 0 days.

(21) Appl. No.: 18/670,080

(22) Filed: May 21, 2024

(30) Foreign Application Priority Data

May 8, 2024 (CN) ..... 202420975725.1

(51) Int. Cl.

| | |
|---|---|
| ***A63B 21/00*** | (2006.01) |
| ***A63B 21/008*** | (2006.01) |
| ***A63B 23/035*** | (2006.01) |
| ***A63B 23/12*** | (2006.01) |
| ***A63B 23/14*** | (2006.01) |
| ***A63B 23/16*** | (2006.01) |

(52) U.S. Cl.

CPC .... *A63B 21/4017* (2015.10); *A63B 21/00185* (2013.01); *A63B 21/0083* (2013.01); *A63B 21/4035* (2015.10); *A63B 21/4047* (2015.10); *A63B 21/4049* (2015.10); *A63B 23/03508* (2013.01); *A63B 23/1281* (2013.01); *A63B 23/14* (2013.01); *A63B 23/16* (2013.01)

(58) Field of Classification Search

CPC ..... A63B 21/00185; A63B 21/0083; A63B 21/4017; A63B 21/4035; A63B 21/4047; A63B 21/4049; A63B 23/03508; A63B 23/14; A63B 23/16

See application file for complete search history.

(56) References Cited

U.S. PATENT DOCUMENTS

| | | | | |
|---|---|---|---|---|
| 10,894,181 | B2 * | 1/2021 | Ocampo | A63B 21/4033 |
| 2019/0009131 | A1 * | 1/2019 | Ocampo | A63B 21/4025 |
| 2021/0299507 | A1 * | 9/2021 | Powell | A63B 23/1281 |

* cited by examiner

*Primary Examiner* — Zachary T Moore

(57) ABSTRACT

Disclosed in the present disclosure is an arm exercise machine, including an upper arm assembly, a forearm assembly and a damping-adjustable hydraulic cylinder, where the upper arm assembly is used for being sleeved on an upper arm, the forearm assembly is used for being sleeved on a forearm, a lower end of the upper arm assembly is rotatably connected to a rear end of the forearm assembly, a cylinder body of the hydraulic cylinder is mounted on a side surface of the forearm assembly, and an end of a piston rod is connected to the upper arm assembly. At least one strap for fixing each of the upper arm assembly and the forearm assembly on an arm is provided on each of the upper arm assembly and the forearm assembly. The present disclosure can be convenient to carry, and can adjust exercise strength without the risk of injuries.

8 Claims, 8 Drawing Sheets

ARM EXERCISE MACHINE

CROSS-REFERENCE TO RELATED APPLICATION

This application claims priority from the Chinese patent application 2024209757251 filed May 8, 2024, the content of which is incorporated herein in the entirety by reference.

TECHNICAL FIELD

The present disclosure relates to the field of athletic equipment, and in particular to an arm exercise machine.

BACKGROUND

If a person needs to exercise his/her arms, generally fitness equipment such as a dumb bell, an arm strength device or a barbell may be used. Although the dumbbell and arm strength device can be carried, if they are not gripped properly during use, they may fall off and pose a risk of damaging a user. Moreover, the dumbbell and the arm strength device can only correspond to one strength per group; if different degrees of strength are needed for exercise, multiple sets of dumbbells or arm strength devices are needed, which is inconvenient to carry; furthermore, the barbell is even more difficult to carry, and generally needs to be used in specialized fitness centers.

At present, there is no arm exercise machine available in the market which can be convenient to carry, can adjust exercise strength, and does not have the risk of injuries due to the arm exercise machine being dropped.

SUMMARY

In order to overcome the above shortcomings, the present disclosure provides an arm exercise machine which can be convenient to carry and can adjust exercise strength.

The technical solution of the present disclosure is as follows:

an arm exercise machine, comprising an upper arm assembly, a forearm assembly and a damping-adjustable hydraulic cylinder; the upper arm assembly is used for being sleeved on an upper arm, the forearm assembly is used for being sleeved on a forearm, a lower end of the upper arm assembly is rotatably connected to a rear end of the forearm assembly, a cylinder body of the hydraulic cylinder is mounted on a side of the forearm assembly, and an end of a piston rod is connected to the upper arm assembly. After a user wears the arm exercise machine, the rotating connection point of the upper arm assembly and the forearm assembly corresponds to the position of the elbow, when the forearms make an upward lifting action, a certain force is required to be used to lift the forearm under the action of the hydraulic cylinder. Since the damping of the hydraulic cylinder is adjustable, the user can adjust the damping according to the force required for exercise according to practical requirements.

Preferably, a positioning ring is provided at a front end of the forearm assembly, a rotating ring is provided within the positioning ring, and a gripping rod is provided within the rotating ring along any diameter direction thereof.

Preferably, a grip strength assembly is provided on the gripping rod, the grip strength assembly comprises at least one guiding post and two gripping handles which are arranged opposite each other, and the guiding post with one end inserted into one of the gripping handles and the other end connected to the other gripping handle vertically penetrates through the gripping rod; a first spring is further sleeved on the guiding post, and two ends of the first spring are respectively connected to the two gripping handles. When a user holds the gripping handles with his/her hands, the first spring can be pressed tightly through a gripping action, the gripping handles on the two sides are close to each other, and after the gripping handles are released, the first spring separates the gripping handles on the two sides. Since a certain gripping force is required in this movement, repeated movements can also have an exercise effect.

Preferably, the two gripping handles are arranged opposite each other in an up-and-down manner, there are at least two guiding posts, each of the gripping handles comprises sleeve rods of which the number is equal to that of the guiding posts, one end of each of the guiding posts is connected to the corresponding sleeve rod of one of the gripping handles, and the other end of each of the guiding posts is inserted into the corresponding sleeve rod of the other gripping handle; and the sleeve rod at a lower end of the upper gripping handle is inserted into the gripping rod, the sleeve rod at an upper end of the lower gripping handle is inserted into the gripping rod, and a circle of transverse conical bosses are provided at ends of at least two outermost sleeve rods inserted into the gripping rod;

the gripping rod is a hollow rod, a pushing member is provided inside each of two sides of the gripping rod, the two pushing members are arranged opposite each other, a circle of longitudinal conical bosses are provided at an inner end of each of the pushing members, and an outer end of each of the pushing members penetrates through the rotating ring and is in contact with the positioning ring; and the transverse conical bosses of the two outermost upper and lower sleeve rods respectively match with the longitudinal conical bosses of the two pushing members; when the upper and lower sleeve rods are close to each other, the conical surface of each of the transverse conical bosses press the conical surface of each of the longitudinal conical bosses, so that the two pushing members move outwards transversely; and when gripping, the two pushing members press the positioning ring outwards, so that the rotating ring does not rotate any more.

Preferably, a circle of groove is provided inwards on an outer wall of the rotating ring, headless screws are provided on an inner wall of the positioning ring, and one end of each of the headless screws is inside the groove. On the one hand, the positioning ring and the rotating ring can rotate relative to each other, and on the other hand, can be mutually limited. A user can rotate and adjust the direction after gripping the gripping rods, and can exercise after reaching a comfortable angle.

Preferably, the forearm assembly comprises two second supports which are arranged opposite each other, two extending supports are provided at a rear end of the positioning ring, each of the extending supports is sleeved on each of the second supports from front to back, a row of positioning holes are provided on a side surface of each of the second supports, and the two adjacent positioning holes are connected through a connecting groove having a width less than the diameter of positioning holes; during use, the two second supports are respectively arranged at two sides of the forearms, and the palms grip the gripping rods within the positioning rings.

The upper arm assembly comprises two first supports which are arranged opposite each other, each of the first supports is sleeved with a telescoping support from top to bottom, a row of positioning holes are also provided on a side surface of each of the first supports, and the two adjacent positioning holes are also connected through a connecting groove having a width less than the diameter of the positioning holes. During use, the two first supports are respectively arranged at two sides of the upper arm.

Preferably, a positioning button is provided within each of the extending supports and the telescoping supports, the positioning button is perpendicular to the respective connecting groove, the positioning button comprises an inner protrusion portion, a moving portion and an outer protrusion portion which are connected to each other, the inner protrusion portion is located on an inner side of the respective first support/the respective second support, and the diameter of the inner protrusion portion is greater than the width of the connecting groove and less than the diameter of the positioning holes; the diameter of the moving portion is less than the width of the connecting groove, and the moving portion is capable of passing through the respective first support/the respective second support through the connecting groove or the positioning hole; the outer protrusion portion is located on an outer side of the respective first support/the respective second support and is embedded into an outer wall of the telescoping support/the extending support, and the diameter of the outer protrusion portion is greater than that of the positioning hole; and a second spring is further provided between the inner protrusion portion and an inner wall of the telescoping support/the extending support; when the inner protrusion portion is at the position of any one of the positioning holes, the second spring pushes the inner protrusion portion into the positioning hole, and by pressing the outer protrusion portion on the outer side, the inner protrusion portion is pressed away from the positioning hole, and at this time, the moving portion is within the positioning hole, and the sliding of the telescoping support/extending support can enable the moving portion of the positioning button to enter the connecting groove, when continuing to slide the support to the position of the next positioning hole, the second spring is reset to enable the inner protrusion portion to pop into the positioning hole due to the loss of pressure; by means of this operation, the length from the top of the telescoping support to the bottom of the first support and the length from the front end of the support to the rear end of the second support can be adjusted, i.e., the total length of the upper arm assembly and the forearm assembly is adjusted.

Preferably, a rear end of each of the second supports is connected to a lower end of each of the first supports through a hinge pin so as to achieve relative rotation therebetween.

Preferably, a row of adjustment holes are further provided on a side surface of each of the second supports, the adjustment holes on each of the second supports are located behind all the positioning holes on the second support, and a front-end positioning rod is detachably connected into one of the adjustment holes, a specific detachable connection manner may be a screw connection, and may also be a connection manner of the above positioning button, as long as the position of the front-end positioning rod can be disassembled and adjusted; a rear-end positioning rod is provided on an outer side of a lower portion of at least one of the first supports; and a front-end collar is provided on the cylinder body of the hydraulic cylinder, a rear-end collar is provided at a rear end of the piston rod, the front-end collar is sleeved on the front-end positioning rod, and the rear-end collar is sleeved on the rear-end positioning rod, the piston rod moves within the cylinder body by lifting or lowering the arm of the user.

Preferably, at least one strap is provided on each of the upper arm assembly and the forearm assembly, and the strap can be mounted on the supports on both sides of the supper arm assembly and the forearm assembly. During use, the exercise machine is tied to the upper arms and the forearms by means of the strap, and even if the hands are released from the gripping rods, the exercise machine will not fall off. The specific number and position can be set according to actual situations, and it can be ensured that the arm exercise machine is tied to the user's arm.

The present disclosure has the following beneficial effects.

The present disclosure has a simple structure and is convenient to carry. During use, an upper arm assembly is sleeved on upper arms, and a forearm assembly is sleeved on forearms. Relative rotation between a hydraulic cylinder and the upper arm assembly and the forearm assembly is used to enable a user to perform a motion similar to a dumbbell belling. Moreover, the hydraulic cylinder can adjust damping, the user can exercise by adjusting different degrees of strength according to her/his requirements.

BRIEF DESCRIPTION OF DRAWINGS

The present disclosure will now be described, by way of example only, with reference to the accompanying drawings in which.

DESCRIPTION OF EMBODIMENTS

The present disclosure will now be described in further detail with reference to the drawings. All these drawings are simplified schematic diagrams for explaining the basic structure of the present disclosure only by way of illustration, and thus only the components related to the present disclosure are shown.

In the description of the present disclosure, it should be noted that the orientation or position relations indicated by the terms "upper", "lower", "inner", "outer", "front end", "rear end", "two ends", "one end", "other end" and the like are based on the orientation or position relations shown in the figures, which is only for the convenience of describing the present disclosure and simplifying the description, rather than indicating or implying that the indicated device or element must have a particular orientation, be constructed and operated in a particular orientation, and therefore cannot be understood that the present disclosure is limited thereto.

In addition, terms such as 'first' and 'second' are used herein for purposes of description and are not intended to indicate or imply relative importance.

In the description of the present disclosure, it should be noted that, unless specified or limited otherwise, the terms "mounted", "provided with", "connected", and the like should be understood broadly, for example, "connected" may be a fixed connection, may also be a detachable connection, or may be an integral connection; may also be mechanical or electrical connections; may also be direct connections or indirect connections via intervening structures; may also be inner communications of two elements; the fixed connection may be welding, screwing, or gluing. A person of ordinary skill in the art may understand the specific meanings of the foregoing terms in the present disclosure according to specific situations.

An arm exercise machine as shown in FIGS. 1-9 comprises an upper arm assembly 1, a forearm assembly 2 and a damping-adjustable hydraulic cylinder 3; the damping-adjustable hydraulic cylinder is an existing mature product and can be obtained by purchase, the upper arm assembly 1 is used for being sleeved on upper arms, and the forearm assembly 2 is used for being sleeved on forearms. At least one strap 6 for fixing the upper arm assembly 1 and the forearm assembly 2 on the arm is provided on each of the upper arm assembly 1 and the forearm assembly 2.

Figure 6:
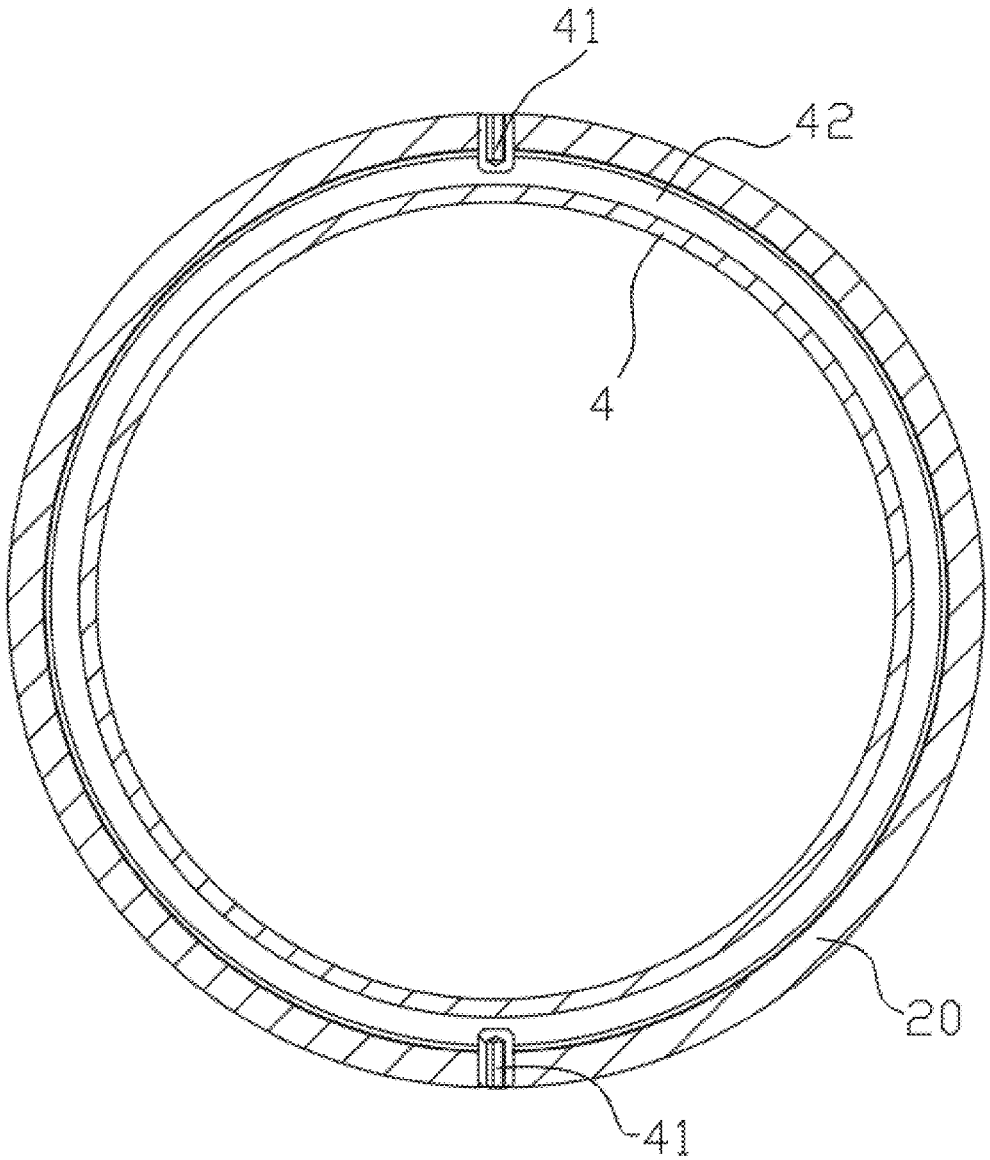
FIG. 6 is a schematic view of the cooperation between a rotating rod and a positioning ring.

A positioning ring 20 is provided at a front end of the forearm assembly 2, as shown in FIG. 6. a rotating ring 4 is provided within the positioning ring 20, a circle of groove 42 is provided inwards on an outer wall of the rotating ring 4, two headless screws 41 are provided on an inner wall of the positioning ring 20, and an inner end of each of the headless screws 41 is inside the groove 42. On the one hand, the positioning ring and the rotating ring can rotate relative to each other, and on the other hand, can be mutually limited. A user can rotate and adjust the direction after gripping the gripping rods, and can exercise after reaching a comfortable angle. A gripping rod 5 is provided within the rotating ring 4 along any diameter direction thereof.

Figure 1:
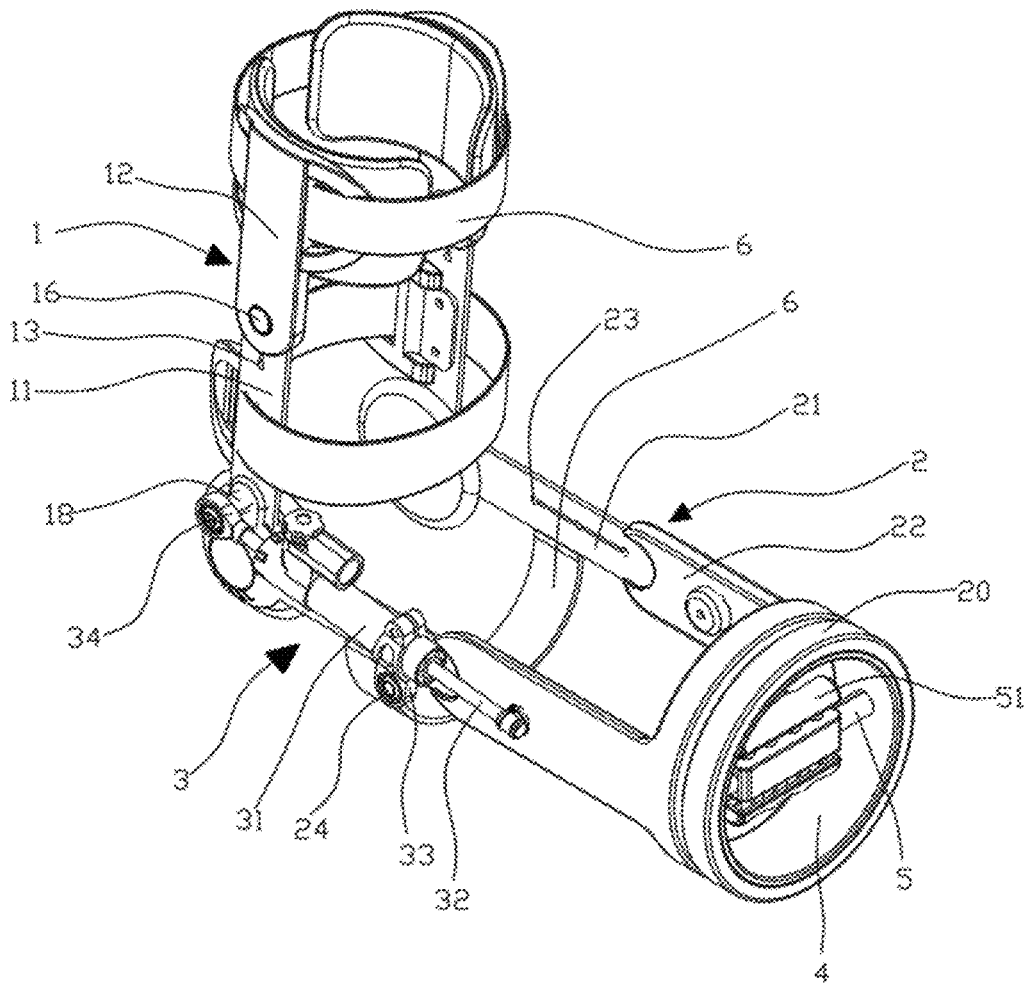
FIG. 1 is a three-dimensional schematic diagram of the present disclosure.
Figure 2:
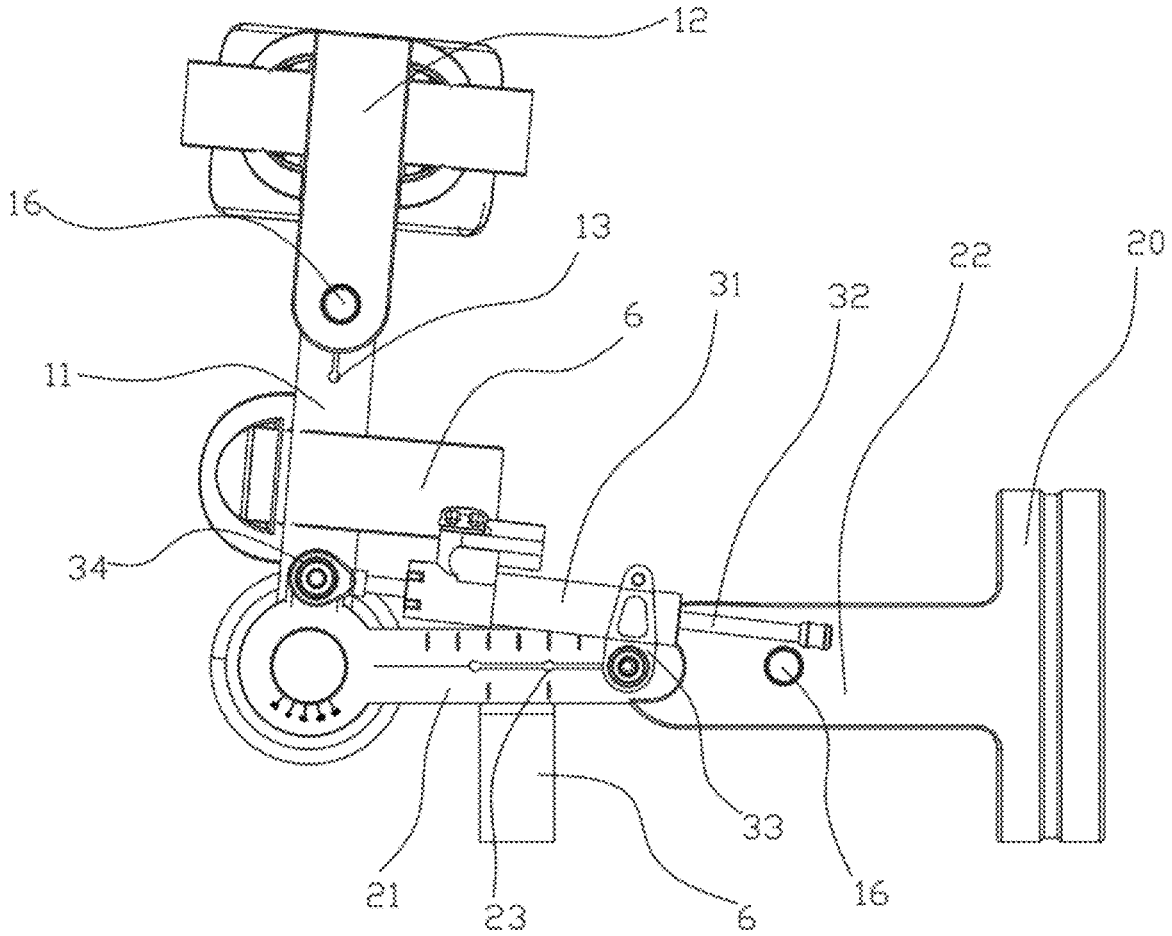
FIG. 2 is a side view of the present disclosure.
Figure 3:
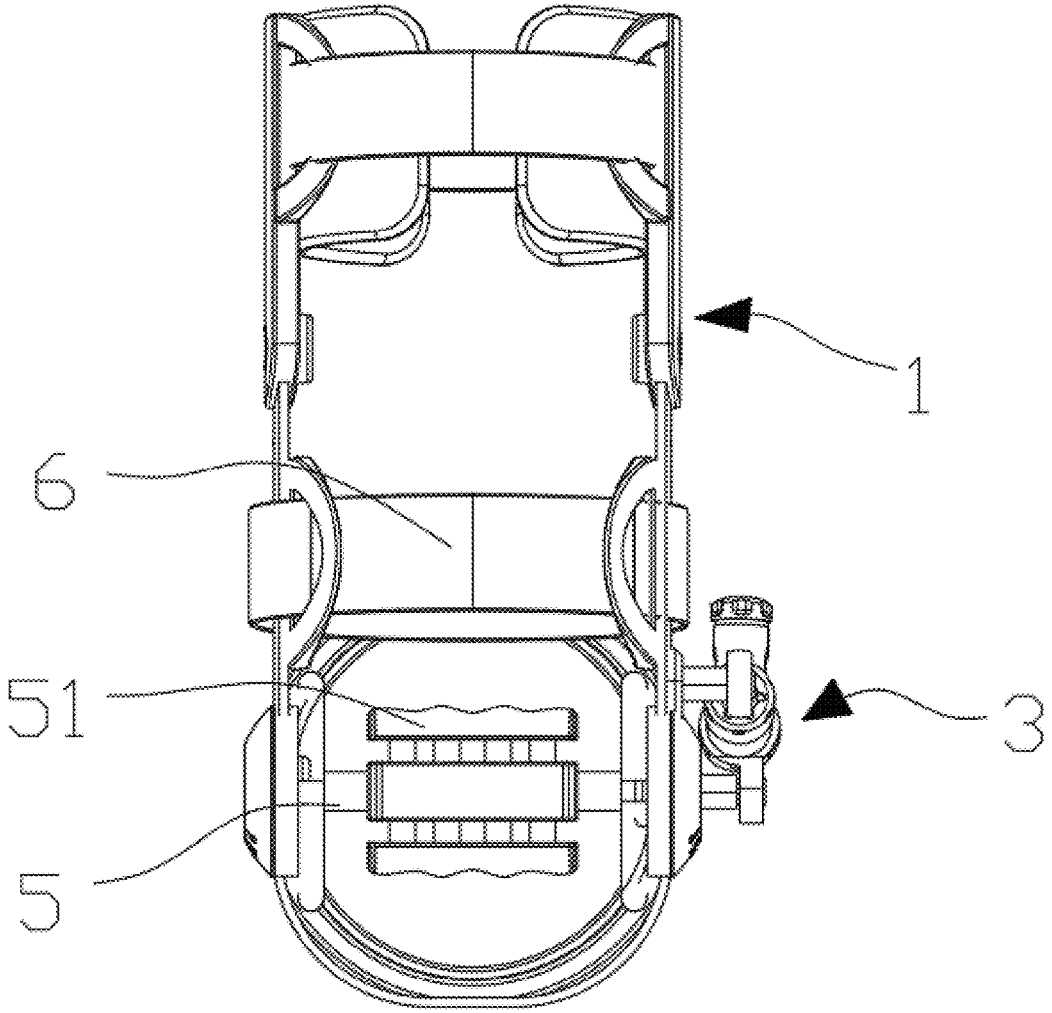
FIG. 3 is a front view of the present disclosure.
Figure 4:
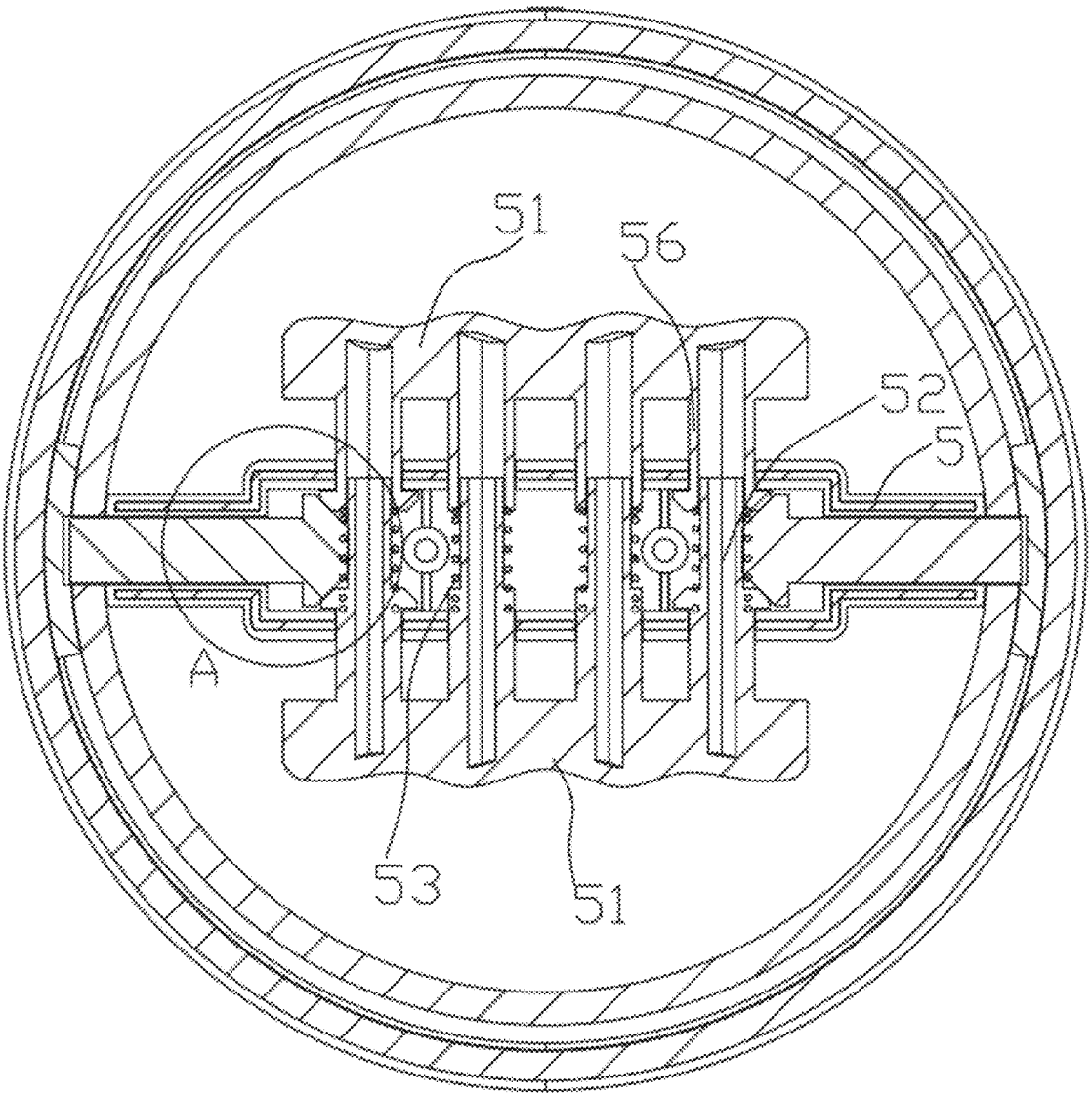
FIG. 4 is a schematic view of the cooperation between a gripping rod and gripping handles.
Figure 5:
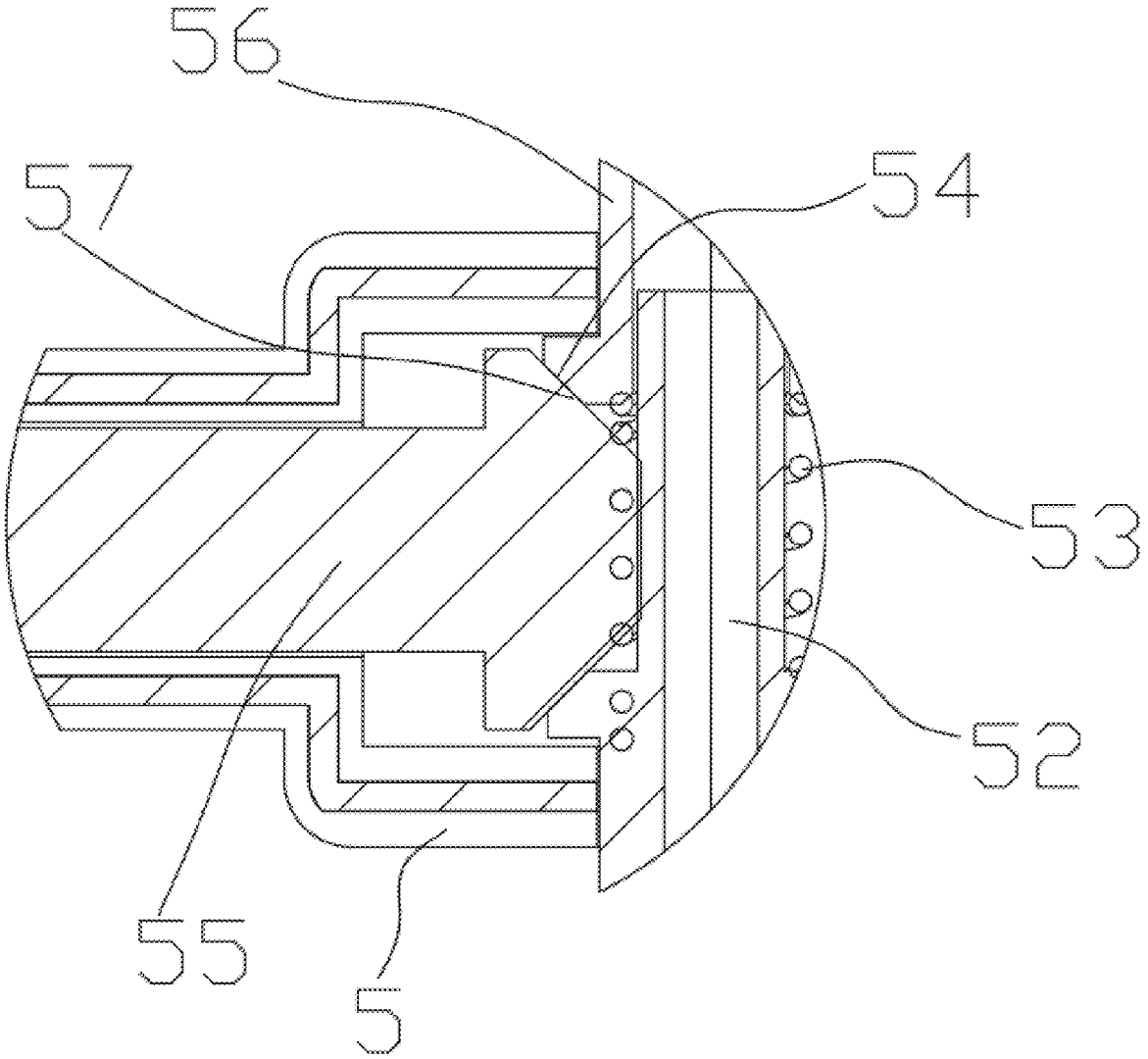
FIG. 5 is an enlarged view of portion A of FIG. 4.

As shown in FIGS. 4-5, a grip strength assembly is provided on the gripping rod 5, the grip strength assembly comprises several guiding posts 52 and two gripping handles 51 which are arranged opposite each other, the two gripping handles 51 are arranged opposite each other in an up-and-down manner, and each of the guiding posts 52 with one end inserted into one of the gripping handles 51 and the other end connected to the other gripping handle 51 vertically penetrates through the gripping rod 5. Specifically, each of the gripping handles 51 comprises sleeve rods 56 of which the number is equal to that of the guiding posts 52, one end of each of the guiding posts 52 is connected to the corresponding sleeve rod 56 of one of the gripping handles 51, and the other end of each of the guiding posts 52 is inserted into the corresponding sleeve rod 56 of the other gripping handle 51; the sleeve rod at a lower end of the upper gripping handle 51 is inserted into the gripping rod 5, the sleeve rod at an upper end of the lower gripping handle 51 is inserted into the gripping rod 5, and a circle of transverse conical bosses 54 are provided at ends of the outermost sleeve rods 56 at two sides inserted into the gripping rod 5; the gripping rod 5 is a hollow rod, a pushing member 55 is provided inside each of two sides of the gripping rod 5, the two pushing members 55 are arranged opposite each other, a circle of longitudinal conical bosses 57 are provided at an inner end of each of the pushing members, and an outer end of each of the pushing members penetrates through the rotating ring 4 and is in contact with the positioning ring 20; and the transverse conical bosses 54 of the two outermost upper and lower sleeve rods 56 respectively match with the longitudinal conical bosses 57 of the two pushing members 55.

A first spring 53 is sleeved on each of the guiding posts 52, and two ends of the first spring 53 are respectively connected to corresponding sleeve rods in the two gripping handles 51. When a user holds the gripping handles with his/her hands, the first spring can be pressed tightly through a gripping action, the gripping handles on the two sides are close to each other, and after the gripping handles are released, the first spring separates the gripping handles on the two sides. Since a certain gripping force is required in this movement, repeated movements can also have an exercise effect. When the upper and lower sleeve rods are close to each other, the conical surface of each of the transverse conical bosses press the conical surface of each of the longitudinal conical bosses, so that the two pushing members move outwards transversely; and when gripping, the two pushing members press the positioning ring outwards, so that the rotating ring does not rotate any more. In order to ensure stability during pushing, a friction sheet can be further provided at a position of the positioning ring corresponding to the pushing member, and when the outer end of the pushing member pushes against the friction sheet, the stability is better.

Figure 7:
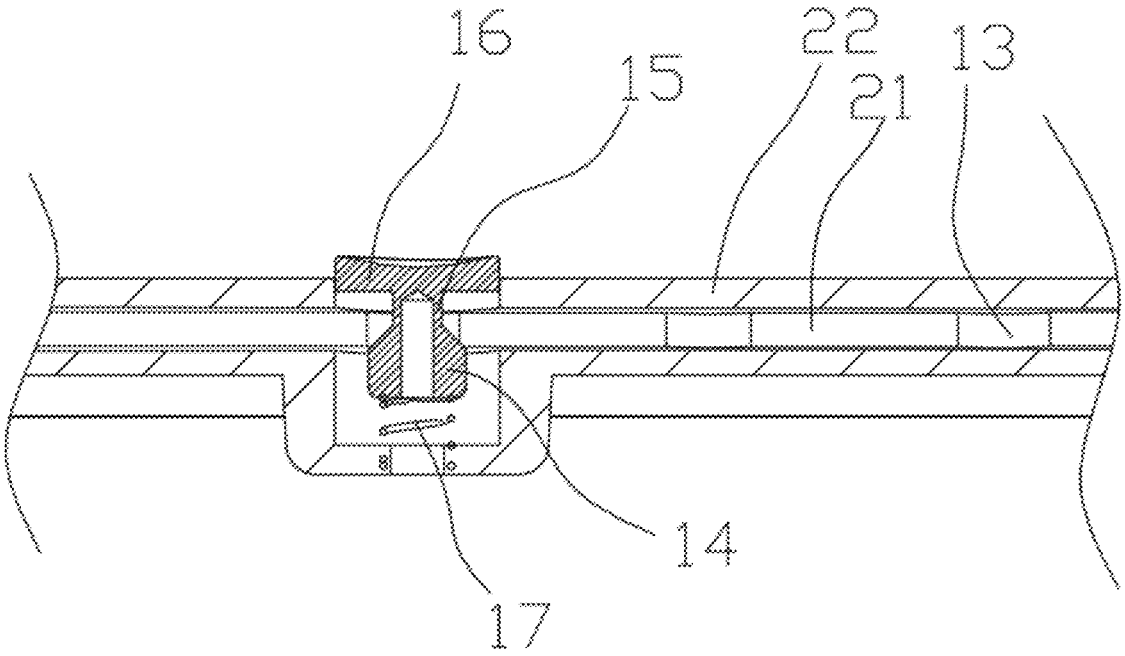
FIG. 7 is a schematic view of the cooperation between a positioning button and a second support and an extending support.
Figure 8:
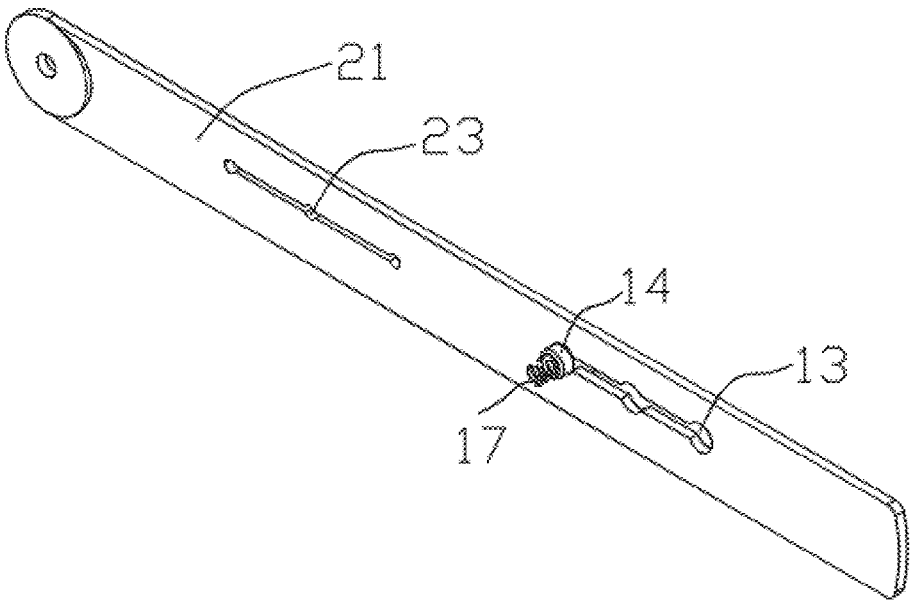
FIG. 8 is a schematic view of a second support.
Figure 9:
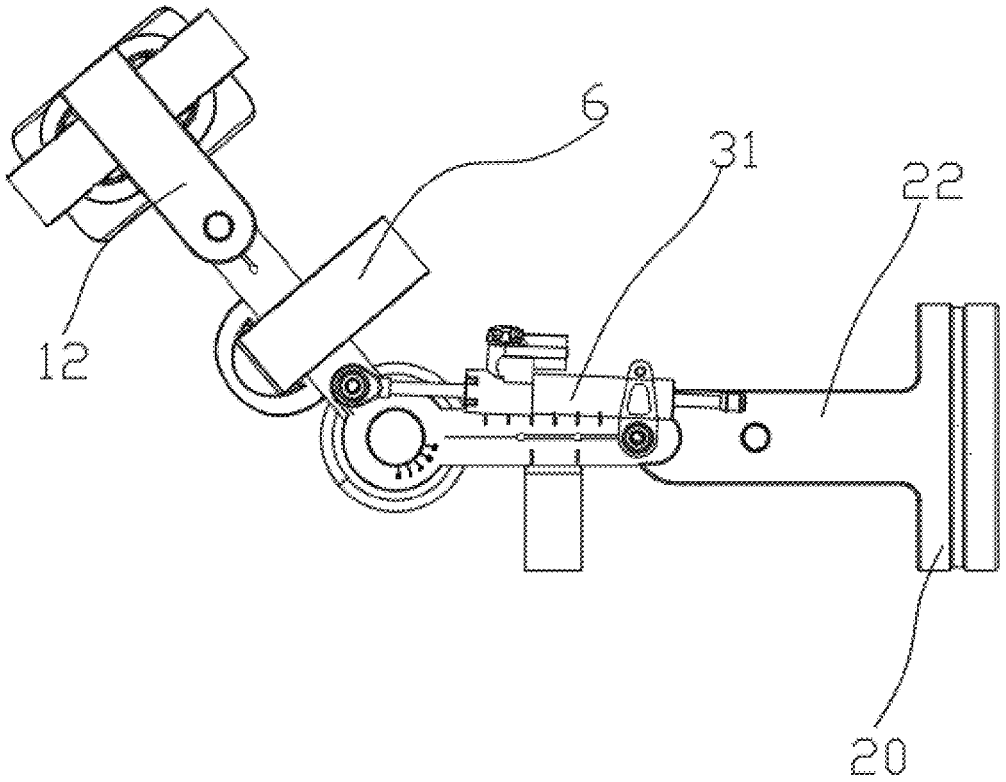
FIG. 9 is a schematic view of the opening of the upper arm assembly and the forearm assembly.

The forearm assembly 2 comprises two second supports 21 which are arranged opposite each other, two extending supports 22 are provided at a rear end of the positioning ring 20, each of the extending supports 22 is sleeved on each of the second supports 21 from front to back, as shown in FIGS. 7-8, a row of positioning holes 13 are provided on a side surface of each of the second supports 21, and the two adjacent positioning holes 13 are connected through a connecting groove having a width less than the diameter of positioning holes; during use, the two second supports are respectively arranged at two sides of the forearms, and the palms grip the gripping rods within the positioning rings. The upper arm assembly 1 comprises two first supports 11 which are arranged opposite each other, each of the first supports 11 is sleeved with a telescoping support 12 from top to bottom, a row of positioning holes 13 are also provided on a side surface of each of the first supports 11, and the two adjacent positioning holes 13 are also connected through a connecting groove having a width less than the diameter of the positioning holes. During use, the two first supports are respectively arranged at two sides of the upper arm.

A positioning button is provided within each of the extending supports 22 and the telescoping supports 12, the positioning button is perpendicular to the respective connecting groove, the positioning button comprises an inner protrusion portion 14, a moving portion 15 and an outer protrusion portion 16 which are connected to each other, the inner protrusion portion 14 is located on an inner side of the respective first support 11/the respective second support 21, and the diameter of the inner protrusion portion is greater than the width of the connecting groove and less than the diameter of the positioning holes 13; the diameter of the moving portion 15 is less than the width of the connecting groove, and the moving portion 15 is capable of passing through the respective first support 11/the respective second support 21 through the connecting groove or the positioning hole; the outer protrusion portion 16 is located on an outer side of the respective first support 11/the second support 21 and is embedded into an outer wall of the telescoping support 12/the extending support 22, and the diameter of the outer protrusion portion 16 is greater than that of the positioning holes 13. A second spring 17 is further provided between the inner protrusion portion 14 and an inner wall of the telescoping support 12/the extending support 22; when the inner protrusion portion is at the position of any one of the positioning holes, the second spring pushes the inner protrusion portion into the positioning hole, and by pressing the outer protrusion portion on the outer side, the inner protrusion portion is pressed away from the positioning hole, and at this time, the moving portion is within the positioning hole, and the sliding of the telescoping support/extending support can enable the moving portion of the positioning button to enter the connecting groove, when continuing to slide the support to the position of the next positioning hole, the second spring is reset to enable the inner protrusion portion to pop into the positioning hole due to the loss of pressure; by means of this operation, the length from the top of the telescoping support to the bottom of the first support and the length from the front end of the support to the rear end of the second support can be adjusted, i.e., the total length of the upper arm assembly and the forearm assembly is adjusted.

The strap can be mounted on the first supports, the second supports, the telescoping support and/or extending support, and then is tightly tied to the upper arms and the forearms. Even if the hands are released from the gripping rods, the exercise machine will not fall off. The specific number and position can be set according to actual situations, and it can be ensured that the arm exercise machine is tied to the user's arm.

A rear end of each of the second supports 21 is connected to a lower end of each of the first supports 11 through a hinge pin so as to achieve relative rotation therebetween. As shown in FIG. 8, a row of adjustment holes 23 are further provided on a side surface of each of the second supports 21, the adjustment holes on each of the second supports 21 are located behind all the positioning holes 13 on the second support, and a front-end positioning rod 24 is detachably connected into one of the adjustment holes 23, a specific detachable connection manner may be a screw connection, and may also be a connection manner of the above positioning button, as long as the position of the front-end positioning rod can be disassembled and adjusted; a rear-end positioning rod 18 is provided on an outer side of a lower portion of at least one of the first supports 11. A front-end collar 33 is provided on the cylinder body 31 of the hydraulic cylinder 3, a rear-end collar 34 is provided at a rear end of the piston rod 32, the front-end collar 33 is sleeved on the front-end positioning rod 24, and the rear-end collar 34 is sleeved on the rear-end positioning rod 18, and the piston rod moves within the cylinder body by lifting or lowering the arm of the user.

Furthermore, a lower end of the upper arm assembly 1 is rotatably connected to a rear end of the forearm assembly 2, a cylinder body 31 of the hydraulic cylinder 3 is mounted on a side of the forearm assembly 2, and an end of a piston rod 32 is connected to the upper arm assembly 1. After a user wears the arm exercise machine, the rotating connection point of the upper arm assembly and the forearm assembly corresponds to the position of the elbow, when the forearms make an upward lifting action, a certain force is required to be used to lift the forearm under the action of the hydraulic cylinder. Since the damping of the hydraulic cylinder is adjustable, the user can adjust the damping according to the force required for exercise according to practical requirements.

According to the present disclosure, a person skilled in the art can make various changes and modifications without departing from the technical concept of the present disclosure. The technical scope of the present disclosure is not limited to the content in the description, and the technical scope of the present disclosure must be determined according to the scope of the claims.

What is claimed is:

1. An arm exercise machine, comprising an upper arm assembly, a forearm assembly and a damping-adjustable hydraulic cylinder, wherein a lower end of the upper arm assembly is rotatably connected to a rear end of the forearm assembly, a cylinder body of the hydraulic cylinder is mounted on the forearm assembly, and an end of a piston rod is connected to the upper arm assembly;

wherein a positioning ring is provided at a front end of the forearm assembly, a rotating ring is provided within the positioning ring, and a gripping rod is provided within the rotating ring along any diameter direction thereof; and wherein a grip strength assembly is provided on the gripping rod, the grip strength assembly comprises at least one guiding post and two gripping handles which are arranged opposite each other, and the guiding post with one end inserted into one of the gripping handles and an other end connected to the other gripping handle vertically penetrates through the gripping rod; and a first spring is further sleeved on the guiding post, and two ends of the first spring are respectively connected to the two gripping handles.

2. The arm exercise machine according to claim 1, wherein the two gripping handles are arranged opposite each other in an up-and-down manner, there are at least two guiding posts, each of the gripping handles comprises sleeve rods of which the number is equal to that of the guiding posts, the one end of each of the guiding posts is connected to the corresponding sleeve rod of one of the gripping handles, and the other end of each of the guiding posts is inserted into the corresponding sleeve rod of the other gripping handle;

the sleeve rod at a lower end of the upper gripping handle is inserted into the gripping rod, the sleeve rod at an upper end of the lower gripping handle is inserted into the gripping rod, and a circle of transverse conical bosses are provided at ends of at least two outermost sleeve rods inserted into the gripping rod;

the gripping rod is a hollow rod, a pushing member is provided inside each of two sides of the gripping rod, the two pushing members are arranged opposite each other, a circle of longitudinal conical bosses are provided at an inner end of each of the pushing members, and an outer end of each of the pushing members penetrates through the rotating ring and is in contact with the positioning ring; and the transverse conical bosses of the two outermost upper and lower sleeve rods respectively match with the longitudinal conical bosses of the two pushing members.

3. The arm exercise machine according to claim 1, wherein a circle of groove is provided inwards on an outer wall of the rotating ring, headless screws are provided on an inner wall of the positioning ring, and one end of each of the headless screws is inside the groove.

4. The arm exercise machine according to claim 1, wherein the forearm assembly comprises two second supports which are arranged opposite each other, two extending supports are provided at a rear end of the positioning ring, each of the extending supports is sleeved on each of the second supports from front to back, a row of positioning holes are provided on a side surface of each of the second supports, and the two adjacent positioning holes are connected through a connecting groove having a width less than the diameter of positioning holes; and the upper arm assembly comprises two first supports which are arranged opposite each other, each of the first supports is sleeved with a telescoping support from top to bottom, a row of positioning holes are also provided on a side surface of each of the first supports, and the two adjacent positioning holes are also connected through a connecting groove having a width less than the diameter of the positioning holes.

5. The arm exercise machine according to claim 4, wherein a positioning button is provided within each of the extending supports and the telescoping supports, the positioning button is perpendicular to the respective connecting groove, the positioning button comprises an inner protrusion portion, a moving portion and an outer protrusion portion which are connected to each other, the inner protrusion portion is located on an inner side of the respective first support/the respective second support, and the diameter of the inner protrusion portion is greater than the width of the connecting groove and less than the diameter of the positioning holes; the diameter of the moving portion is less than the width of the connecting groove, and the moving portion is capable of passing through the respective first support/the respective second support through the connecting groove or the positioning hole; the outer protrusion portion is located on an outer side of the respective first support/the respective second support and is embedded into an outer wall of the telescoping support/the extending support, and the diameter of the outer protrusion portion is greater than that of the positioning holes; and a second spring is further provided between the inner protrusion portion and an inner wall of the telescoping support/the extending support.

6. The arm exercise machine according to claim 4, wherein a rear end of each of the second supports is connected to a lower end of each of the first supports through a hinge pin.

7. The arm exercise machine according to claim 4, wherein a row of adjustment holes are further provided on a side surface of each of the second supports, the adjustment holes on each of the second supports are located behind all the positioning holes on the second support, and a front-end positioning rod is detachably connected into one of the adjustment holes; a rear-end positioning rod is provided on an outer side of a lower portion of at least one of the first supports; and a front-end collar is provided on the cylinder body of the hydraulic cylinder, a rear-end collar is provided at a rear end of the piston rod, the front-end collar is sleeved on the front-end positioning rod, and the rear-end collar is sleeved on the rear-end positioning rod.

8. The arm exercise machine according to claim 1, wherein at least one strap is provided on each of the upper arm assembly and the forearm assembly.

* * * * *